US006238226B1

(12) United States Patent
Schempp et al.

(10) Patent No.: US 6,238,226 B1
(45) Date of Patent: May 29, 2001

(54) EDGE CONNECTOR FOR FLAT CIRCUITRY

(75) Inventors: Otto Schempp, Bad Rappenau; Herbert Endres, Bad Wimpfen, both of (DE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/417,005

(22) Filed: Oct. 12, 1999

(30) Foreign Application Priority Data

Oct. 16, 1998 (EP) ..... 98119572

(51) Int. Cl.[7] ..... H01R 13/15
(52) U.S. Cl. ..... 439/260; 439/636
(58) Field of Search ..... 439/259, 260–267, 439/637, 636

(56) References Cited

U.S. PATENT DOCUMENTS

| | | | | |
|---|---|---|---|---|
| 3,474,387 | * | 10/1969 | Krum et al. | 439/260 |
| 4,021,091 | * | 5/1977 | Anhult et al. | 439/260 |
| 4,373,764 | * | 2/1983 | Ulrich | 439/260 |
| 4,428,635 | * | 1/1984 | Hamsher, Jr. et al. | 439/260 |
| 4,530,553 | * | 7/1985 | Aujla | 439/260 |
| 4,560,221 | | 12/1985 | Olsson | 339/75 |
| 4,575,171 | | 3/1986 | Igarashi et al. | 339/74 |
| 4,606,594 | | 8/1986 | Grabbe et al. | 339/74 |
| 4,611,870 | | 9/1986 | Beers | 339/75 |
| 4,613,193 | | 9/1986 | Beers | 339/17 |
| 4,648,668 | | 3/1987 | Sinisi | 339/74 |
| 4,684,194 | | 8/1987 | Jenkins et al. | 439/260 |
| 4,695,111 | | 9/1987 | Grabbe et al. | 439/266 |
| 4,705,338 | | 11/1987 | Sitzler | 439/260 |
| 4,720,156 | | 1/1988 | Beers | 439/260 |
| 4,743,203 | | 5/1988 | Grabbe | 439/260 |
| 4,815,979 | | 3/1989 | Porter | 439/62 |
| 4,863,395 | | 9/1989 | Babuka et al. | 439/260 |
| 4,904,197 | | 2/1990 | Cabourne | 439/260 |
| 4,919,626 | * | 4/1990 | Anhalt et al. | 439/260 |
| 4,952,162 | | 8/1990 | Hikami et al. | 439/161 |
| 5,059,133 | | 10/1991 | Hikami et al. | 439/161 |
| 5,308,249 | | 5/1994 | Renn et al. | 439/62 |
| 5,391,089 | * | 2/1995 | Quickel et al. | 439/260 |
| 5,679,018 | | 10/1997 | Lopata et al. | 439/260 |
| 5,709,562 | | 1/1998 | Kourimsky | 439/267 |

FOREIGN PATENT DOCUMENTS

| | | | |
|---|---|---|---|
| 4-245183 | 9/1992 | (JP) | H01R/23/68 |
| 9-92410 | 4/1997 | (JP) | H01R/23/00 |
| 10-41025 | 2/1998 | (JP) | H01R/23/00 |

* cited by examiner

*Primary Examiner*—Hien Vu
(74) *Attorney, Agent, or Firm*—A. A. Tirva; Robert A. Yesukevich

(57) ABSTRACT

An electrical connector system includes a dielectric housing having a pair of wings defining a circuit-receiving slot therebetween. A plurality of terminals are mounted on the housing. The terminals have contact portions located at opposite sides of the slot. A flat circuit has an edge insertable into the slot. An actuator is mounted on and carried by the flat circuit. The actuator has actuator portions operatively associated with the terminals to bias the contact portions of the terminals into engagement with opposite sides of the flat circuit in response to inserting the edge of the circuit into the slot.

3 Claims, 6 Drawing Sheets

10A

EDGE CONNECTOR FOR FLAT CIRCUITRY

FIELD OF THE INVENTION

This invention generally relates to the art of electrical connectors and, particularly, to connectors which commonly are called "edge card connectors" for receiving the edges of flat circuitry such as printed circuit boards.

BACKGROUND OF THE INVENTION

Electrical connectors are well known in the art for interconnecting a primary printed circuit board (often called a "mother" board) and a secondary printed circuit board (often called a "daughter" board). The connections between the two circuit boards typically are made along an edge of the secondary circuit board which, therefore, commonly is referred to as an edge card.

Such edge card connectors typically include an insulating or dielectric housing mountable on the primary or mother board. The housing has a card-receiving slot for receiving the edge of the secondary or daughter board. A plurality of terminals are mounted on the housing along one or both sides of the slot, and the terminals have flexible contact portions projecting into the slot for engaging appropriate circuit traces on one or both sides of the secondary circuit board.

One of the problems with edge card connectors as described above is that the sharp edge of the inserted edge card engages and wipes the flexible contact portions of the terminals during insertion of the edge card into the card-receiving slot in the housing. At least the contact portions of the terminals typically are plated with a highly conductive precious metal. The substrate of the edge card typically is fabricated of abrasive material, such as glass fibers. If the lead-in edge of the card engages and wipes over the plated contact portions, degradation of the contact plating occurs.

In order to solve the above-identified problem, zero insertion force (ZIF) connectors have been designed such the edge card is inserted into the card-receiving slot of the connector with zero or minimum wiping action on the plated contact portions of the terminals. In some connectors, minimum wiping action still is afforded to remove oxidation at the contact surfaces, but the forces are not sufficient for the edge card to significantly damage the plating of the contact surfaces. Heretofore, such ZIF connectors have been fairly complicated because actuators, springs, cams and other devices are mounted on the connector housing to effect terminal or contact engagement after the edge card is fully inserted into the card-receiving slot of the housing. The present invention is directed to solving these problems by a very simple, efficient, cost-effective and unique system which employs a simple actuator mounted on and carried by the edge card, itself and allows at the same time to use a wide variety of daughter board thicknesses without degradation of the spring performance of the connector.

SUMMARY OF THE INVENTION

An object, therefore, of the invention is to provide a new and improved electrical connector system of the character described, for terminating a flat circuit, such as the edge of a printed circuit board.

In the exemplary embodiment of the invention, the electrical connector system includes a dielectric housing having a pair of wings defining a circuit-receiving slot therebetween. A plurality of terminals are mounted on the housing, with contact portions of the terminals located at opposite sides of the slot. A flat circuit has an edge insertable into the slot. An actuator is mounted on and carried by the flat circuit. The actuator has actuator portions operatively associated with the terminals to bias the contact portions of the terminals into engagement with opposite sides of the flat circuit in response to inserting the edge of the circuit into the slot.

As disclosed herein, the actuator portions of the actuator comprise actuator arms projecting toward the edge and extending generally parallel to the flat circuit. The arms are located a distance from the edge of the flat circuit such that the edge of the circuit passes the contact portions of the terminals before the contact portions are biased into engagement with opposite sides of the flat circuit.

In one embodiment of the invention, the terminals are mounted such that the contact portions thereof are exposed within the slot. The contact portions are fixed relative to the wings of the housing. The actuator portions are engageable with the wings to bias the wings and, in turn, the contact portions toward the slot and the flat circuit. In the preferred embodiment, the wings comprise independent portions of the housing movable relative to a body portion of the housing. Complementary interengaging cams are provided between the wings of the housing and the actuator portions of the actuator.

In a second embodiment of the invention, the terminals are mounted such that the contact portions thereof are movable relative to the wings of the housing. The terminals include actuating portions coupled to the contact portions and engageable by the actuator portions of the actuator to bias the contact portions into engagement with opposite sides of the flat circuit. Each terminal is generally U-shaped to define a first leg forming the contact portion inside the wing at the slot, and a second leg forming the actuating portion exposed exteriorly of the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
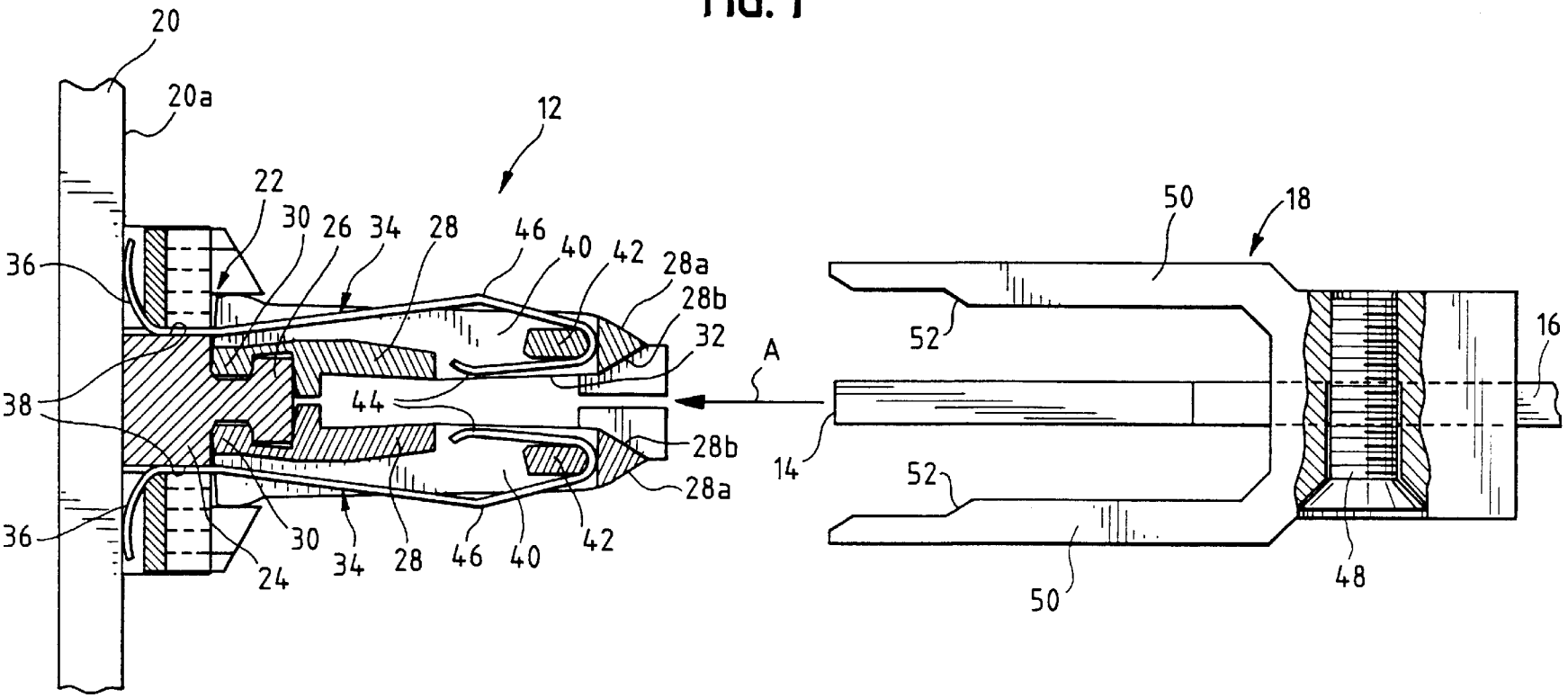
FIGS. 1–3 are sequential views of mating a printed circuit board with an edge card connector according to a first embodiment of the invention, with the connector in section.

Referring to the drawings in greater detail, and first to FIG. 1, a first embodiment of an electrical connector system, generally designated 10, is shown to include an edge card connector, generally designated 12, for receiving an edge 14 of a flat circuit such as a printed circuit board 16. The circuit board is inserted into the connector in the direction of arrow "A" and carries therewith an actuator, generally designated 18. More particularly, connector 12 is adapted for mounting on a primary printed circuit board, "mother" board or backplane 20. If circuit board 20 is a "mother" board, circuit board 16 typically would be referred to as the secondary or "daughter" board. In any event, printed circuit board 16 will be referred to hereinafter as the edge card.

Connector 12 includes a dielectric housing, generally designated 22, which includes a body portion 24 mounted to circuit board 20. The connector and body portion are elongated in a direction perpendicular to the drawings and include a forwardly projecting T-shaped flange 26. The housing includes a pair of wings 28 project forwardly of body portion 24 and terminate in pointed distal ends which define outside chamfered surfaces 28*a* and inside chamfered surfaces 28*b*. Wings 28 are independent portions of housing 22 and are mounted to body portion 24 by embracing T-shaped flange 26. The wings of the housing can pivot slightly relative to the body portion about points 30. The wings combine to form an elongated circuit or card receiving slot 32 therebetween.

A plurality of terminals, generally designated 34, are mounted in two rows along elongated housing 22. Each terminal includes a tail portion 36 for connection, as by soldering or press-on, to circuit traces on a surface 20*a* of printed circuit board 20. The terminals are fixed within holes 38 in body portion 24 of the connector housing. The terminals have elongated U-shaped contact arms which project forwardly from body portion 24 into terminal-receiving passages 40 formed in wings 28. The U-shaped ends of the contact arms are wrapped around swivel bosses 42 spanning passages 40. The U-shaped configuration of the contact arms form inside legs defining contact portions 44 of the terminals and outside legs defining actuating portions 46 of the terminals. In the inoperative condition of connector 12 shown in FIG. 1, contact portions 44 are located within passages 40 and do not project into card-receiving slot 32. Actuating portions 46 project outwardly beyond the outside bounds of wings 28.

Still referring to FIG. 1, it now can be understood that edge 14 of edge card 16 is insertable in the direction of arrow "A" into slot 32 between wings 28 of connector 12. Actuator 18 is fixed to edge card 16 by appropriate means such as bolts, rivets or other appropriate fasteners 48. The actuator includes a pair of actuator arms 50 spaced from edge card 16. The actuator arms have inside cams 52. The actuator arms extend generally parallel to the edge card, and inside cams 52 are spaced inwardly of edge 14 of the card.

Figure 2:
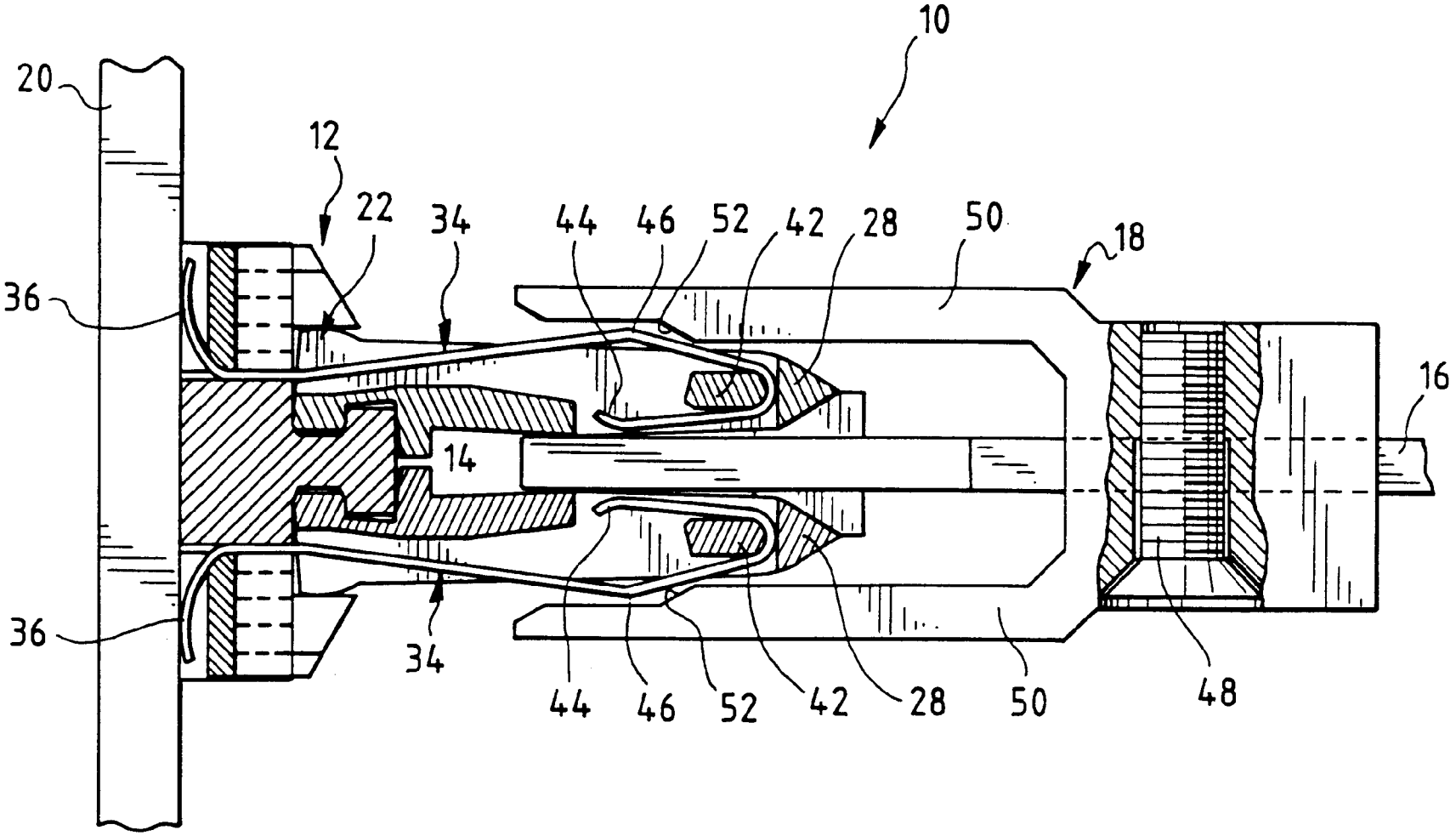

FIG. 2 shows edge card 16 inserted only partially into slot 32 of connector 12. It can be seen that edge 14 of the edge card has passed contact portions 44 of terminals 34, but inside cams 52 of actuator arms 50 have not as yet engaged outside actuating portions 46 of the terminals. Therefore, edge 14 of the edge card will not damage or degrade the plating on contact portions 44 of the terminals. It should be noted that, during insertion, inside chamfered surfaces 28*b* of wings 28 help guide edge 14 of edge card 26 into slot 32. Outside chamfered surface 28*a* of the wings can engage inside cams 52 of actuator arms 50 to further guide the insertion action.

Figure 3:
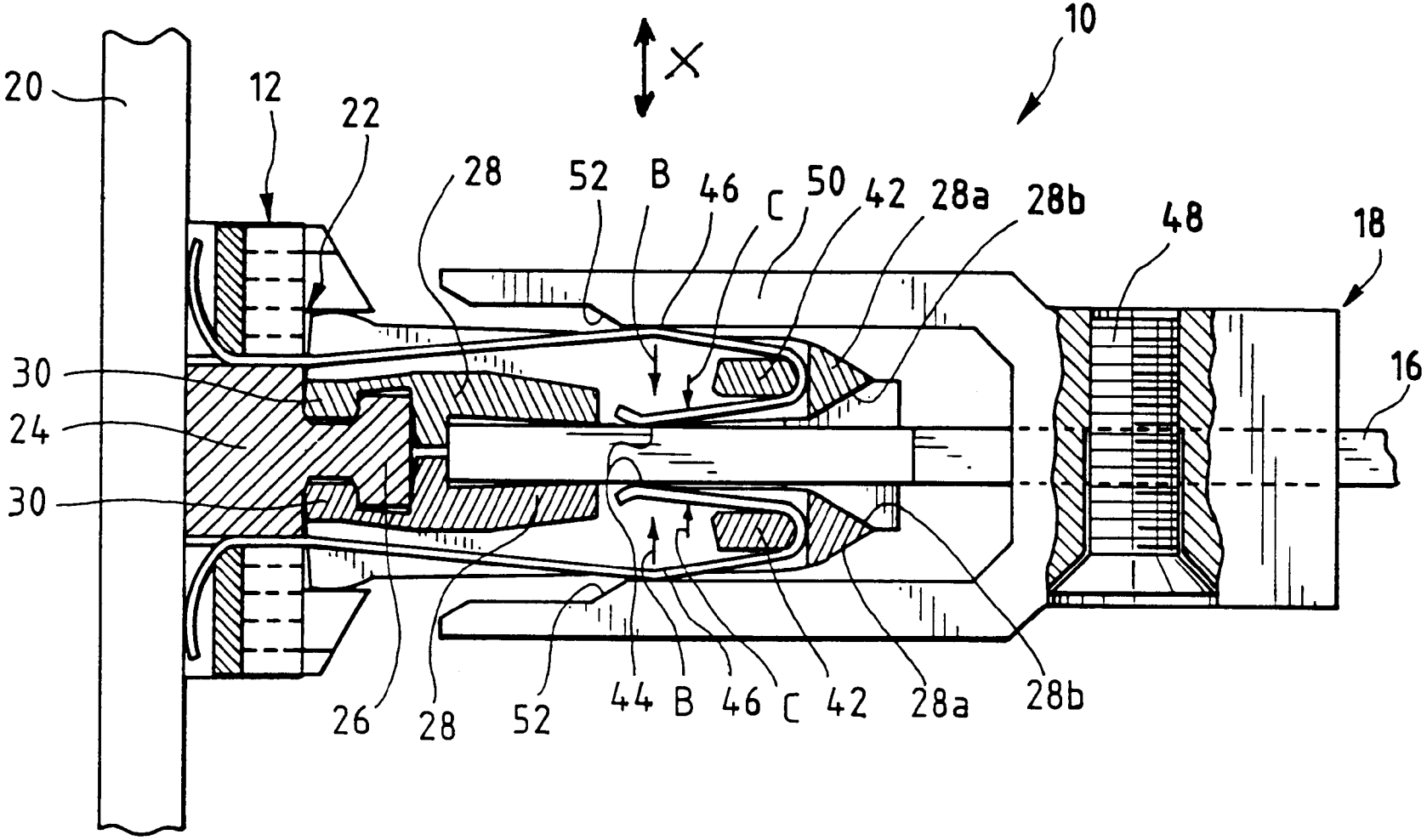

FIG. 3 shows edge card 16 filly inserted into connector 12. It can be seen that inside cams 52 of actuator arms 50 of actuator 18 have engaged actuating portions 46 of terminals 34 and have biased the actuating portions of the terminals inwardly in the direction of arrow "B". Because of the U-shaped configuration of the contact arms of the terminals, and because contact portions 44 of the terminals thereby are coupled with actuating portions 46, contact portions 44 swivel about swivel bosses 42 and move inwardly in the direction of arrows "C" into engagement with appropriate circuit traces on opposite sides of edge card 16. Any wiping action between the edge card and contact portions 44 is limited to the smooth side surfaces of the edge card, rather than the abrupt edge 14 of the card, and only for a distance necessary to cause inside cams 52 of the actuator arms to effect movement of the terminals. It also should be understood that the actuating height or distance between actuator arms 50 and their inside cams 52 is totally independent of the thickness of edge card 16. For this reason the normal force reliability is independent of the daughter board thickness. It is possible to insert a thin daughter board into a connector which has accepted a thick multilayer board behind without any degradation of normal forces. In addition the connector allows a certain misalignment in the "x" direction (FIGS. 3) without affecting the normal forces.

Figure 4:
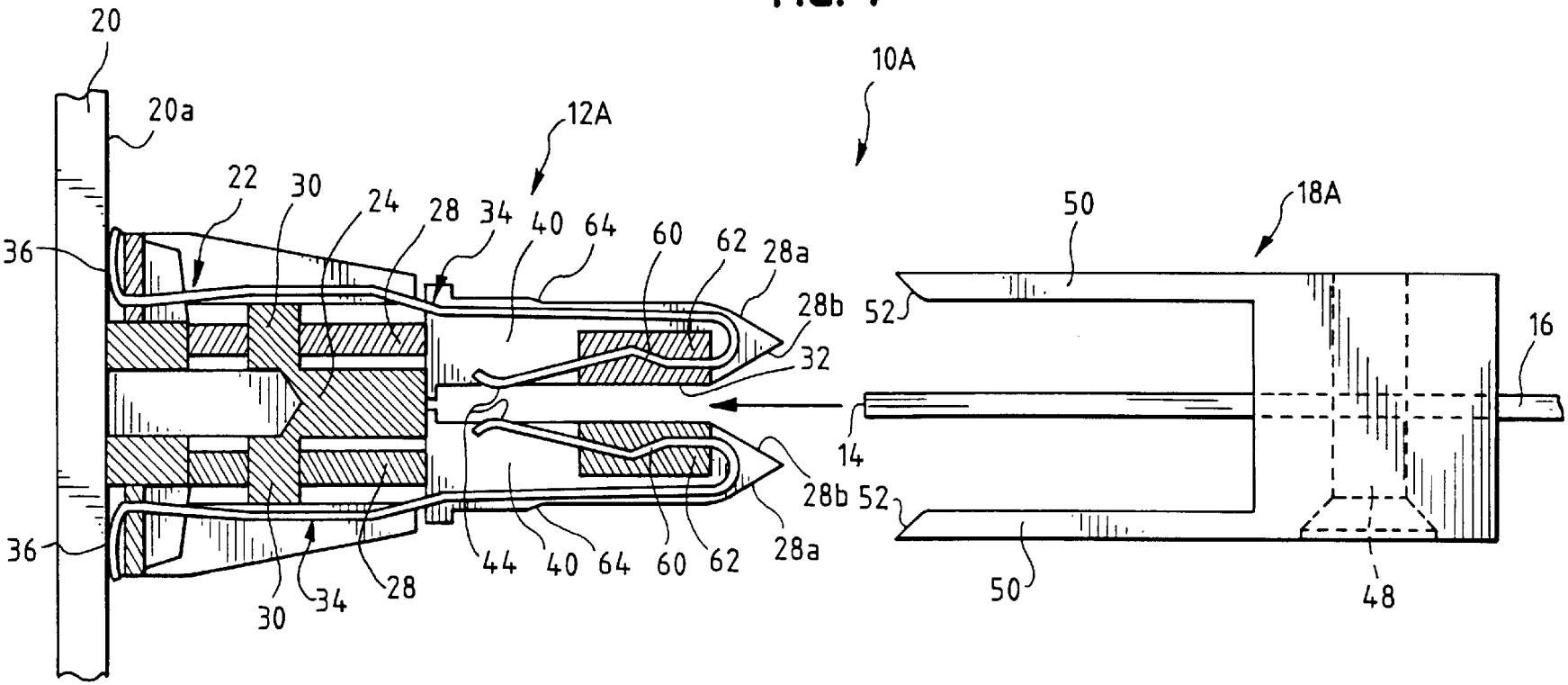
FIGS. 4–6 are views similar to that of FIGS. 1–3, but of a second embodiment of the invention.
Figure 5:
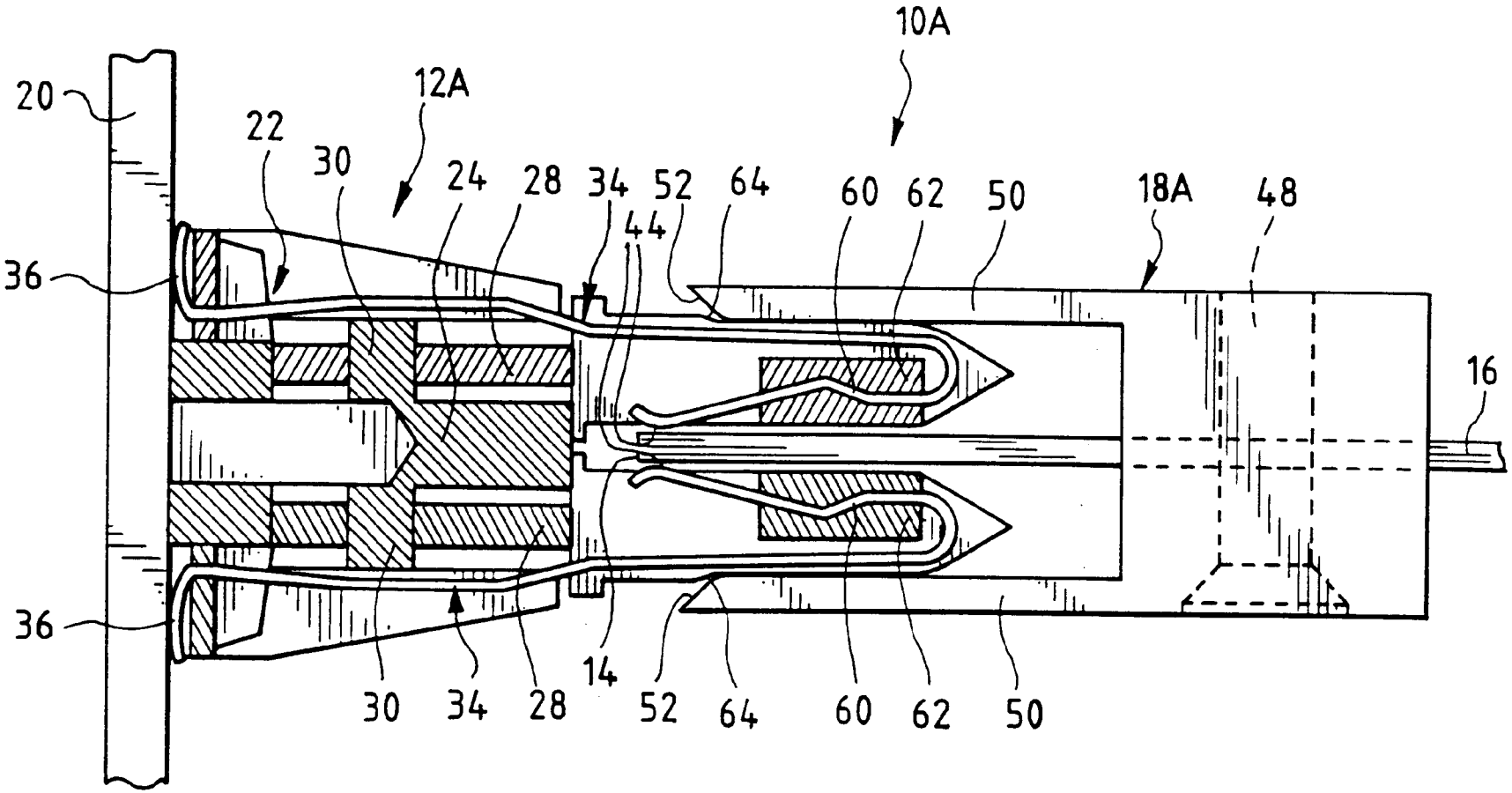
Figure 6:
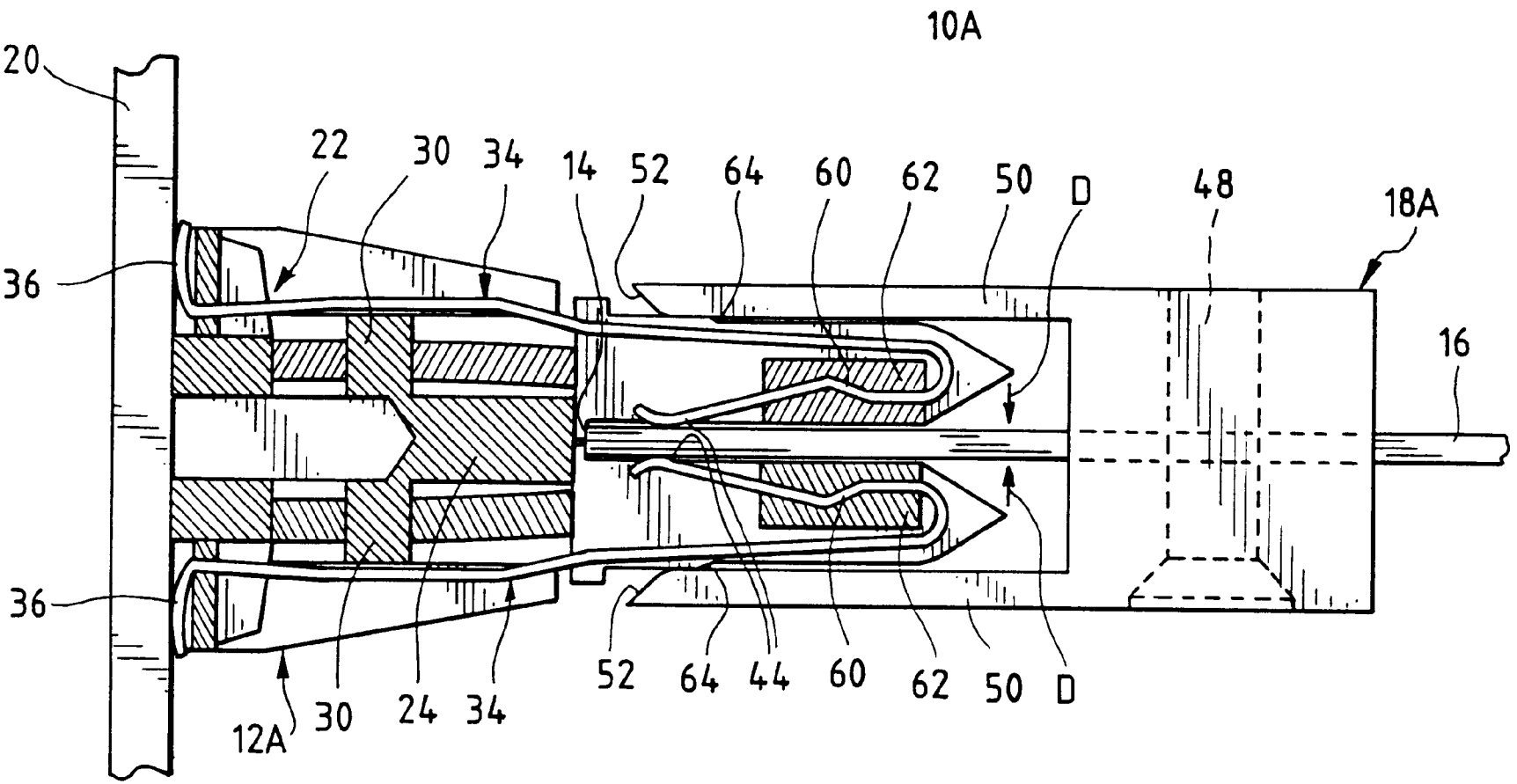

FIGS. 4–6 show a second embodiment of an electrical connector system, generally designated 10A, embodying the concepts of the invention. System 10A includes an edge card connector, generally designated 12A, for receiving an edge card 16 which carries an actuator, generally designated 18A. Because of the general similarity between systems 10 and 10A, like reference numerals have been applied in FIGS. 4–6 corresponding to like components described above in relation to FIGS. 1–3.

For instance, edge card 16 includes an insertion edge 14. Actuator 18A is fixed to the edge card by fastener(s) 48. The actuator has actuator arms 50 and inside cams 52. Connector 12A is mounted to a primary circuit board or backplane 20. The connector includes a housing 22 with a body portion 24 and a pair of wings 28 movable relative to the body portion about pivot bosses 30. Two rows of terminals, generally designated 34, are mounted to the body portion of the housing and have tail portions 36 connected to circuit traces on circuit board 20. Generally U-shaped contact arms of the terminals define contact portions 44 at opposite sides of a card-receiving slot 32. There are two rows of terminals extending longitudinally of the connector, and the contact arms of the terminals extend into terminal-receiving passages 44 in wings 28.

The principal differences between system 10A and connector 12A versus system 10 and connector 12 reside in terminals 34 having legs 60 fixed within partitions 62 which span passages 40 of wings 28. The housing components of either connectors 12 or 12A can be fabricated of dielectric material such as plastic or the like. Therefore, terminals arms 60 can be overmolded within partitions 62. With terminal arms 60 being fixed relative to the wings, contact portions 44 permanently project into slot 32. Finally, the outsides of wings 28 are provided with outside cams 64 which are engageable with inside cams 52 of actuator arms 50 of actuator 18A.

FIG. 5 shows edge card 16 only partially inserted into slot 32 of connector 12A between wings 28. It can be seen that edge 14 of the edge card has passed contact portions 44 of the terminals, and inside cams 52 of the actuator have not as yet engaged outside cams 64 of the wings. Therefore, the sharp edge 14 of the edge card will engage the contact portions with minimum or negligible forces not sufficient to cause significant damage or degradation to the plating on the contact portions.

FIG. 6 shows edge card 16 fully inserted into slot 32 of connector 12A. It can be seen that inside cams 52 of actuator arms 50 of actuator 18A have engaged outside cams 64 of wings 28 to bias the wings inwardly toward the edge card in the direction of arrows "D". With contact arms 60 and contact portions 44 fixed to partitions 62 of the wings, this biasing action is effective to bias contact portions 44 inwardly into positive engagement with appropriate circuit traces on opposite sides of edge card 16. Again, the distance between actuator arms 50 and their inside cams 52 is totally independent of the thickness of circuit card 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector system, comprising:

a dielectric housing having a pair of wings defining a board-receiving slot between one of the wines and the other of the wings, each of the wings defining a terminal-receiving passage, and each of the wings including a swivel boss adjacent a far end of the wing, and;

a plurality of terminals mounted on the housing, each of the terminals including a U-shaped contact arm which projects forwardly into one of the terminal-receiving passages and wraps around the swivel boss, each of the U-shaped contact arms including an inside leg which defines a contact portion and an outside leg which defines an actuating portion, with contact portions of the terminals located at opposite sides of the slot and being movable relative to the wings of the housing;

a printed circuit board having an edge insertable into the slot; and an actuator mounted on and carried by the printed circuit board, the actuator having actuator arms extending generally parallel to the printed circuit board and engageable with the actuating portions of the terminals to bias the contact portions of the terminals into engagement with opposite sides of the printed circuit board in response to inserting the edge of the board into the slot, the actuator arms having engaging portions located a distance from the edge of the printed circuit board such that the edge of the board passes the contact portions of the terminals before the contact portions are biased into engagement with opposite sides of the circuit board.

2. The electrical connector system of claim 1 wherein said printed circuit board constitutes a secondary board, with said housing being mounted on a primary printed circuit board.

3. An electrical connector system, comprising:

a dielectric housing having a pair of wings defining a board-receiving slot between one of the wings and the other of the wings, each of the wings having an outside cam and a terminal-receiving passage and each of the wings including a partition which spans the passage adjacent a far end of the wing;

a plurality of terminals mounted on the housing, each of the terminals including a U-shaped contact arm which projects forwardly into one of the terminal-receiving passages and is fixed within the partition, each of the U-shaped contact arms including an inside leg which defines a contact portion and an outside leg positioned adjacent one of the outside cams, with contact portions of the terminals located at opposite sides of the slot and being movable relative to the wings of the housing;

a printed circuit board having an edge insertable into the slot; and an actuator mounted on and carried by the printed circuit board, the actuator having actuator arms extending generally parallel to the printed circuit board and engageable with the outside cams to bias the wings and, thereby, to bias the contact portions of the terminals into engagement with opposite sides of the printed circuit board in response to inserting the edge of the board into the slot, the actuator arms having engaging portions located a distance from the edge of the printed circuit board such that the edge of the board passes the contact portions of the terminals before the contact portions are biased into engagement with opposite sides of the circuit board.

* * * * *